US011911687B2

(12) United States Patent
De Graaf

(10) Patent No.: US 11,911,687 B2
(45) Date of Patent: Feb. 27, 2024

(54) FRAME AND WHEEL ASSEMBLY FOR AN INLINE SKATE, INLINE SKATE, RETROFITTING METHOD AND REPLACEMENT MOUNT

(71) Applicant: Railway Inventions Europe Limited, Delft (NL)

(72) Inventor: Hendrik Jan De Graaf, Delft (NL)

(73) Assignee: Railway Inventions Europe Limited, Delft (NL)

( * ) Notice: Subject to any disclaimer, the term of this patent is extended or adjusted under 35 U.S.C. 154(b) by 0 days.

(21) Appl. No.: 17/611,217

(22) PCT Filed: May 13, 2020

(86) PCT No.: PCT/NL2020/050305
§ 371 (c)(1),
(2) Date: Nov. 15, 2021

(87) PCT Pub. No.: WO2020/231258
PCT Pub. Date: Nov. 19, 2020

(65) Prior Publication Data

US 2022/0226717 A1 Jul. 21, 2022

(30) Foreign Application Priority Data

May 15, 2019 (NL) ..... 2023147

(51) Int. Cl.
*A63C 17/06* (2006.01)

(52) U.S. Cl.
CPC ..... *A63C 17/06* (2013.01)

(58) Field of Classification Search
CPC ..... A63C 17/06; A63C 17/04
See application file for complete search history.

(56) References Cited

U.S. PATENT DOCUMENTS 2,212,589 A 8/1940 Decker
4,763,909 A * 8/1988 Bergeron ..... A63C 5/035 280/11.27
4,928,982 A 5/1990 Logan
(Continued)

FOREIGN PATENT DOCUMENTS

EP 2078543 A1 7/2009
JP 2010022782 A 2/2010

OTHER PUBLICATIONS

International Search Report dated Sep. 30, 2020, Application No. PCT/NL2020/050305.

*Primary Examiner* — Brian L Swenson
(74) *Attorney, Agent, or Firm* — The Dobrusin Law Firm, PC

(57) ABSTRACT

This invention relates to an improved wheel arrangement of an inline skate for improving turning capability. In this wheel arrangement, the front wheel and rear wheel and any middle wheels are disposed along a straight line that makes an acute angle with the rolling direction and with the wheels being arranged such that they are part of a substantially inverted V-shape seen in front or rear plan view. Subject of the invention are a frame, a wheel assembly, combinations of left and right frames and wheel assemblies, inline skates, a method for retrofitting a prior art frame and a replacement mount for use in such a method.

20 Claims, 10 Drawing Sheets

(56) References Cited

U.S. PATENT DOCUMENTS

| | | | | |
|---|---|---|---|---|
| 5,251,920 | A * | 10/1993 | McHale | A63C 17/04 280/11.19 |
| 5,303,940 | A | 4/1994 | Brandner | |
| 5,382,031 | A * | 1/1995 | Marconato | A63C 17/0073 280/11.223 |
| 5,566,957 | A | 10/1996 | Ho | |
| 6,003,882 | A | 12/1999 | Colonese, Jr. et al. | |
| 6,173,975 | B1 * | 1/2001 | Brandner | A63C 17/06 301/5.306 |
| 8,251,383 | B2 | 8/2012 | Dickie | |
| 11,077,356 | B2 * | 8/2021 | Beylin | A63C 17/16 |
| 2002/0063403 | A1 * | 5/2002 | Rudolph | A63C 17/06 280/11.221 |
| 2002/0113383 | A1 * | 8/2002 | Teyhen | A63C 17/004 280/11.115 |
| 2003/0116930 | A1 * | 6/2003 | Gorisch | A63C 17/04 280/11.221 |
| 2004/0094918 | A1 * | 5/2004 | Egeraat | A63C 17/0066 280/11.223 |
| 2005/0218609 | A1 * | 10/2005 | Owen | A63C 17/064 280/11.231 |
| 2010/0084830 | A1 * | 4/2010 | Biesse | A63C 17/0073 280/11.25 |
| 2018/0029660 | A1 | 2/2018 | Petutschnig | |

* cited by examiner

FRAME AND WHEEL ASSEMBLY FOR AN INLINE SKATE, INLINE SKATE, RETROFITTING METHOD AND REPLACEMENT MOUNT

BACKGROUND OF THE INVENTION

The invention relates to inline skates and parts thereof, a retrofitting method for retrofitting an inline skate and a replacement mount for an inline skate.

Inline skating is a popular sport in which for instance ice speed skating can be mimicked on land using a set of wheels that are disposed along a substantially straight trajectory below a skate shoe.

Improvements to inline skates are usually directed to improving maneuverability, stability, and speed.

An example of a prior art inline skate is disclosed in US patent publication U.S. Pat. No. 2,212,589. The disclosed inline skate comprises a frame and a set of wheels including a front wheel and a rear wheel. The frame is provided with guards and straps to firmly secure a shoe to the frame. The front wheel and the rear wheel are mounted to the frame in a manner so that the front wheel is on the outside of the skate and the rear wheel is on the inside of the skate. Both the rear wheel and the front wheel are inclined relative to a vertical plane. The rear wheel extends obliquely with an upper half extending on the inside of the skate next to a heel plate of the frame and a lower half extending to below the heel plate. Similarly, the front wheel extends obliquely with an upper half extending on the outside of the skate next to a sole plate of the frame and a lower half extending to below the sole plate. As such the front wheel and the rear wheel form a V-shape when looked in front plan view or rear plan view.

Although the prior art inline skate is considered to provide a foot supporting frame which is so balanced between the front and rear wheel that it is much easier to change the direction of travel of the skate than to do so with conventional two-wheeled skates, this inline skate has the problem that the turning ability of the wheel assembly for speed skating is still not optimal. This problem increases in size when the number of wheels increase and thus the wheel assembly increases in length.

Using a V-shaped orientation is also known from other disclosures, e.g. as shown in European patent publication EP2078543A1 (see FIG. 11 of the disclosure). The purpose of the inclination of the wheels is to improve stability during skating, because the contact patches of the wheels are then positioned below the skate shoe.

Other examples can be found in US2002/0063403A1, U.S. Pat. Nos. 6,003,882, 5,566,957 and 5,303,940, in which the wheels are arranged in an alternating angular array, with adjacent wheels disposed on opposite sides of a plane vertical to the mounting plate. This is also called a V-line construction.

BRIEF SUMMARY OF THE INVENTION

In view of the above, it is an object of the invention to provide a wheel assembly for an inline skate with an improved cornering behavior.

According to a first aspect of the invention, this object is achieved by providing a wheel assembly for an inline skate, comprising:

a frame; and a set of wheels including a front wheel and a rear wheel, wherein the frame includes a shoe mount for mounting a skate shoe to the frame, a front wheel mount for holding the front wheel, and a rear wheel mount for holding the rear wheel, wherein the wheel assembly has an assembled state in which the front wheel is held by the front wheel mount and the rear wheel is held by the rear wheel mount, wherein the wheel assembly in the assembled state has a length, a width and a height extending respectively in an X-direction, a Y-direction and a Z-direction of a Cartesian coordinate system, an X-Y plane of the Cartesian coordinate system being tangent to both the front wheel and the rear wheel at or near contact patches of the front wheel and the rear wheel, i.e. at or near contact regions of the front wheel and the rear wheel where the front wheel and the rear wheel are intended to engage with a ground surface during use, wherein the front wheel has a front wheel rotation axis and a front wheel rotation plane extending perpendicular to the front wheel rotation axis and through a center of the front wheel, wherein the rear wheel has a rear wheel rotation axis and a rear wheel rotation plane extending perpendicular to the rear wheel rotation axis and through a center of the rear wheel, and wherein, in the assembled state of the wheel assembly, the front wheel rotation plane and the rear wheel rotation plane have an intersection line, which intersection line seen in a plane extending through the center of the rear wheel parallel to a Z-Y plane of the Cartesian coordinate system is located at a frame side of said X-Y plane.

The invention is based on the insight that arranging the wheels such that an inverted V-shape is obtained when looking in a front or rear plan view results in an improved cornering behavior as the wheels have different angular orientations with respect to the ground surface (i.e. different camber angles), so that the wheel assembly will follow a curved path similar to a skate blade of an ice speed skate having a radius of curvature without having to arrange the wheels along a trajectory having a radius of curvature. As a result thereof, it is possible to have all the wheels contact the ground surface at the same time and still experience an improved cornering behavior. Further, stability may be improved as the consequence of the wheel arrangement according to the first aspect of the invention is that the wheels will be disposed along a substantially straight trajectory that makes an angle with a natural rolling direction of the wheel assembly. As a result thereof, not only pivoting the foot in the inline skate about an axis parallel to the rolling direction allows to control the angular orientation of the wheel assembly relative to the ground surface but also pivoting the foot about an axis perpendicular to the rolling direction.

In an embodiment, the front wheel rotation plane or the rear wheel rotation plane extends parallel to the Z-direction in which case the front wheel rotation plane or the rear wheel rotation plane preferably also extends parallel to the X-direction.

In an embodiment, the front wheel rotation plane is oriented such that a rolling direction of the front wheel over a plane ground surface when the X-Y plane of the wheel assembly is parallel to said ground surface is in the X-direction.

In an embodiment, the rear wheel rotation plane is oriented such that a rolling direction of the rear wheel over a plane ground surface when the X-Y plane of the wheel assembly is parallel to said ground surface is in the X-direction.

In an embodiment, the contact patches of the front wheel and the rear wheel are disposed along a substantially straight trajectory making an acute angle with a rolling direction of the wheel assembly defined by the front wheel and rear wheel, said acute angle being preferably in the range of 0.1-20 degrees, more preferably in the range of 0.5-15 degrees, most preferably in the range of 1-10 degrees, e.g. an angle such that a distance between the contact patch of the front wheel and the contact patch of the rear wheel in the Y-direction is at least 10 mm, preferably at least 15 mm. Combined with the front wheel rotation plane and the rear wheel rotation plane extending parallel or substantially to the X-direction, the rolling direction is in the X-direction when the X-Y plane of the wheel assembly is parallel to the ground surface.

In an embodiment, the frame includes a middle wheel mount for holding a middle wheel, wherein the set of wheels includes a middle wheel having a middle wheel rotation axis and a middle wheel rotation plane extending perpendicular to the middle wheel rotation axis and through a center of the middle wheel, and wherein in the assembled state of the wheel assembly:

the middle wheel is held by the middle wheel mount;

a contact patch of the middle wheel, i.e. a contact region of the middle wheel that is intended to engage with the ground surface, is disposed along the trajectory;

the middle wheel rotation plane and a wheel rotation plane of a wheel in front of the middle wheel have an intersection line, which intersection line seen in a plane extending through the center of the middle wheel parallel to a Z-Y plane of the Cartesian coordinate system is located at a frame side of said X-Y plane, and the middle wheel rotation plane and a wheel rotation plane of a wheel behind the middle wheel have an intersection line, which intersection line seen in a plane extending through the center of the middle wheel parallel to a Z-Y plane of the Cartesian coordinate system is located at a frame side of said X-Y plane.

In an embodiment, one or more middle wheels are present, wherein one of the middle wheels has an orientation that is similar to the orientation of one of the other wheels, for instance similar to the orientation of the rear wheel, the front wheel or one of the other middle wheels.

In an embodiment, seen in a plane parallel to a Z-Y plane of the Cartesian coordinate system, an angle between the middle wheel rotation plane and the front wheel rotation plane is smaller than an angle between the rear wheel rotation plane and the front wheel rotation plane.

In an embodiment, a ratio of the angle between the middle wheel rotation plane and the front wheel rotation plane and the angle between the middle wheel rotation plane and the rear wheel rotation plane is substantially equal to a ratio of a distance between the middle wheel rotation axis and the front wheel rotation axis and a distance between the middle wheel rotation axis and the rear wheel rotation axis.

In an embodiment, seen in a plane parallel to a Z-Y plane of the Cartesian coordinate system, an angle between the front wheel rotation plane and the rear wheel rotation plane is in the range of 0.1 or 0.5 to 15 or 20 degrees, preferably in the range of 1-11 degrees, more preferably in the range of 2-9 degrees and most preferably in the range of 3-6 degrees, e.g. 2, 3, 4, 5 or 6 degrees.

In an embodiment, the middle wheel rotation plane extends parallel to the Z-direction in which case the middle wheel rotation plane preferably also extends parallel to the X-direction.

In an embodiment, the middle wheel rotation plane is oriented such that a rolling direction of the middle wheel over a plane ground surface when the X-Y plane of the wheel assembly is parallel to said ground surface is in the X-direction.

In an embodiment, a location or orientation of one or more rotation planes of respective one or more wheels of the set of wheels are adjustable.

The first aspect of the invention also relates to a frame suitable for a wheel assembly according to the first aspect of the invention.

The first aspect of the invention also relates to a combination of a left wheel assembly for a left skate shoe and a right wheel assembly for a right skate shoe to form a pair of wheel assemblies for a pair of inline skates, wherein the left and right wheel assembly are both a wheel assembly according to the first aspect of the invention.

In an embodiment, the left wheel assembly is mirror symmetric with respect to the right wheel assembly. However, in an embodiment, the mirror symmetry may only apply when ignoring an offset camber angle for all wheels, which offset camber angle may be advantageous on a track in which cornering to one side occurs more often than to the other side. The offset camber angle may then aid in cornering to the side that occurs the most. The offset camber angle may in the range of 0.1-10 degrees, preferably 1-6 degrees, more preferably 2-4 degrees, e.g. 0.1, 0.5, 1, 2, 3 or 4 degrees.

In an embodiment, the contact patch of the front wheel of the left wheel assembly and the contact patch of the front wheel of the right wheel assembly are arranged more to an outside of the respective left and right wheel assembly than the corresponding contact patch of the rear wheel of the left wheel assembly and the contact patch of the rear wheel of the right wheel assembly.

Alternatively, the contact patch of the front wheel of the left wheel assembly and the contact patch of the front wheel of the right wheel assembly are arranged more to an inside of the respective left and right wheel assembly than the corresponding contact patch of the rear wheel of the left wheel assembly and the contact patch of the rear wheel of the right wheel assembly.

Alternatively, the contact patch of the front wheel of the left wheel assembly is arranged more to an inside than the corresponding contact patch of the rear wheel of the left wheel assembly while the contact patch of the front wheel of the right wheel assembly is arranged more to an outside than the corresponding contact patch of the rear wheel of the right wheel assembly.

Alternatively, the contact patch of the front wheel of the left wheel assembly is arranged more to an outside than the corresponding contact patch of the rear wheel of the left wheel assembly while the contact patch of the front wheel of the right wheel assembly is arranged more to an inside than the corresponding contact patch of the rear wheel of the right wheel assembly.

The terms "outside" and "inside" correspond to the well-known indications lateral side and medial side, respectively, as also used as the standard anatomical terms of location in medicine for the human body.

The first aspect of the invention further relates to an inline skate comprising a skate shoe and a wheel assembly according to the first aspect of the invention.

In an embodiment, the set of wheels are arranged below the skate shoe. Hence, the wheels do not extend beyond the sides of the skate shoe.

In an embodiment, the skate shoe defines a foot supporting surface configured to support a foot of a user, which foot supporting surface is substantially perpendicular to the Z-direction, i.e. parallel to the X-Y plane.

In an embodiment, the height of the wheel assembly is larger than any wheel diameter of the set of wheels.

The first aspect of the invention further relates to a combination of a left inline skate and a right inline skate, wherein the left inline skate comprises a skate shoe for the left foot of a user and a wheel assembly according to the first aspect of the invention, and wherein the right inline skate comprises a skate shoe for the right foot of a user and a wheel assembly according to the first aspect of the invention.

The first aspect of the invention further relates to a method to retrofit an inline skate, wherein the method comprises the following steps:

a) providing an inline skate including a frame having a front wheel mount for holding a front wheel and a rear wheel mount for holding a rear wheel;

b) replacing the frame by a frame according to the invention or a frame of a wheel assembly according to the invention.

In an embodiment, the front wheel and the rear wheel of the inline skate are transferred to the new frame. Alternatively, the front wheel and the rear wheel are replaced along with the frame, so that the entire wheel assembly is replaced.

The first aspect of the invention yet further relates to a method to retrofit a frame for an inline skate, wherein the method comprises the following steps:

a) providing the frame having a front wheel mount for holding a front wheel and a rear wheel mount for holding a rear wheel;

b) connecting a replacement mount to the front wheel mount and/or the rear wheel mount such that after mounting the front wheel and the rear wheel to the frame, the front wheel and the rear wheel form part of a substantially inverted V-shape seen in rear of front plan view.

The invention according to the first aspect also relates to a replacement mount for use in a retrofitting method according to the first aspect of the invention.

According to a second aspect of the invention, there is provided a frame for an inline skate, comprising:

a shoe mount for a skate shoe;

a front wheel mount defining a front wheel rotation axis for a front wheel;

a rear wheel mount defining a rear wheel rotation axis for a rear wheel; and a middle wheel mount arranged between the front wheel mount and the rear wheel mount and defining a middle wheel rotation axis for a middle wheel, wherein preferably the front wheel rotation axis extends substantially perpendicular to a longitudinal direction of the frame, wherein preferably the rear wheel rotation axis extends substantially perpendicular to said longitudinal direction, and wherein preferably the middle wheel rotation axis extends substantially perpendicular to said longitudinal direction, wherein an orientation of the middle wheel rotation axis about said longitudinal direction is at a first angle with an orientation of the front wheel rotation axis about said longitudinal direction, an orientation of the rear wheel rotation axis about said longitudinal direction is at a second angle with the orientation of the middle wheel rotation axis about said longitudinal direction, and the orientation of the rear wheel rotation axis about said longitudinal direction is at a third angle with the orientation of the front wheel rotation axis about said longitudinal direction, which third angle has a value that is equal to the sum of the absolute value of the first angle and the absolute value of the second angle.

In an embodiment, one of the first or second angles is zero while the other one is non-zero. Preferably, both the first and second angles are non-zero.

In an embodiment, the front wheel mount, the middle wheel mount and the rear wheel mount are disposed along a substantially straight trajectory making an acute angle with said longitudinal direction, said acute angle preferably being in the range of 0-15 degrees.

The described acute angle may be provided so that when wheels are mounted to the frame, the contact patches of the wheel also make an acute angle with said longitudinal direction. However, the acute angle may also be provided to compensate for the camber angle and dispose the contact patches along a substantially straight trajectory that is parallel to the longitudinal direction.

In an embodiment, seen in rear plan view, the orientation of the middle wheel rotation axis about said longitudinal direction is rotated clockwise through the first angle relative to the orientation of the front wheel rotation axis about said longitudinal direction, and the orientation of the rear wheel rotation axis about said longitudinal direction is rotated clockwise through the second angle relative to the orientation of the middle wheel rotation axis about said longitudinal direction.

In an embodiment, seen in rear plan view, the orientation of the middle wheel rotation axis about said longitudinal direction is rotated counterclockwise through the first angle relative to the orientation of the front wheel rotation axis about said longitudinal direction, and the orientation of the rear wheel rotation axis about said longitudinal direction is rotated counterclockwise through the second angle relative to the orientation of the middle wheel rotation axis about said longitudinal direction.

In an embodiment, a ratio between the first angle and the second angle is equal to a ratio between a distance between the middle wheel mount and the front wheel mount and a distance between the middle wheel mount and the rear wheel mount.

In an embodiment, the middle wheel mount is a first middle wheel mount and the middle wheel rotation axis is a first middle wheel rotation axis, wherein the frame further comprises a second middle wheel mount arranged between the first middle wheel mount and the rear wheel mount and defining a second middle wheel rotation axis that extends perpendicular to said longitudinal direction, and wherein an orientation of the second middle wheel rotation axis about said longitudinal direction is at a fourth angle with the orientation of the first middle wheel rotation axis about said longitudinal direction, the orientation of the rear wheel rotation axis about said longitudinal direction is at a fifth angle with the orientation of the second middle wheel rotation axis about said longitudinal direction, the sum of the absolute value of the fourth angle and the absolute value of the fifth angle being equal to the value of the second angle.

In an embodiment, a ratio between the fourth angle and the fifth angle is equal to a ratio between a distance between the second middle wheel mount and the first middle wheel mount and a distance between the second middle wheel mount and the rear wheel mount.

In an embodiment, the third angle has an absolute value between 0.5-20 degrees, preferably between 5-13 degrees, more preferably between 6-9 degrees and most preferably has an absolute value of 7 degrees. The third angle may for instance be 2, 3, 4, 5 or 6 degrees.

In an embodiment, one or more angles between orientations of corresponding rotation axes are adjustable.

The second aspect of the invention also relates to a wheel assembly including a frame according to the second aspect of the invention, and a set of wheels including:

a front wheel to be mounted to the front wheel mount of the frame;

a rear wheel to be mounted to the rear wheel mount of the frame; and a middle wheel to be mounted to the middle wheel mount of the frame.

The second aspect of the invention further relates to a combination of a left frame for a left skate shoe and a right frame for a right skate shoe to form a pair of frames for a pair of skate shoes, wherein the left and right frame are a frame according to the second aspect of the invention.

The second aspect of the invention yet also relates to an inline skate including a skate shoe and a wheel assembly according to a second aspect of the invention.

The second aspect of the invention yet further relates to a method to retrofit an inline skate, wherein the method comprises the following steps:

c) providing an inline skate including a frame;

d) replacing the frame by a frame according to the second aspect of the invention.

In an embodiment, the front wheel, middle wheel and the rear wheel of the inline skate are transferred to the new frame. Alternatively, the front wheel, middle wheel and the rear wheel are replaced along with the frame, so that the entire wheel assembly is replaced.

The second aspect of the invention yet further relates to a method to retrofit a frame for an inline skate, wherein the method comprises the following steps:

c) providing a frame having a front wheel mount for holding a front wheel, a middle wheel mount for holding a middle wheel, and a rear wheel mount for holding a rear wheel;

d) connecting a replacement mount to the front wheel mount and/or the middle wheel mount and/or the rear wheel mount thereby turning the frame into a frame according to the second aspect of the invention.

The invention according to the second aspect also relates to a replacement mount for use in a retrofitting method according to the second aspect of the invention.

It is explicitly noted here that embodiments and features described in relation to the first aspect of the invention and embodiments and features described in relation to the second aspect of the invention are interchangeable where possible. For instance, the wheel assembly according to the first aspect of the invention may comprise a frame according to the second aspect of the invention.

According to a third aspect of the invention, there is provided an inline skate comprising:

a skate shoe with a foot support surface for supporting the foot of a user;

a frame including a shoe mount for mounting a skate shoe to the frame; and a set of wheels including at least two wheels, wherein the frame includes wheel mounts to hold the set of wheels, wherein the wheel assembly has an assembled state in which the skate shoe is mounted to the frame and the set of wheels are held by the frame, wherein each wheel of the set of wheels has a wheel rotation axis and a wheel rotation plane extending perpendicular to the wheel rotation axis and through a center of the wheel, and wherein in the assembled state:

the inline skate defines a plane extending perpendicular to the foot support surface;

at least one wheel has a non-zero camber angle relative to said plane;

in case a wheel has a zero camber angle, the respective wheel rotation axis extends perpendicular to said plane; and in case a wheel has a non-zero camber angle, the respective wheel rotation axis in plan view make a non-zero angle relative to a normal to said plane, which non-zero angle is such that a direction of travel of the wheel at least partially compensates for a cornering behavior due to the non-zero camber angle.

In an embodiment, all wheels having a non-zero camber angle have a camber angle in the same direction, i.e. all wheels having a non-zero camber angle lean in the same direction, i.e. towards the same side.

In an embodiment, the angle of a wheel rotation axis in plan view relative to the normal to said plane is proportional to the corresponding camber angle of the wheel.

In an embodiment, contact patches of the wheels lie on a line parallel to said plane.

In an embodiment, contact patches of the wheels lie on a line making a non-zero angle with said plane.

The third aspect of the invention may readily be combined with any of the first and/or second aspects of the invention. In case the third aspect of the invention is combined with the second aspect of the invention, the angles are such that the wheel rotation axes still extend substantially perpendicular to the longitudinal direction, i.e. the angles are less than 10 degrees, preferably less than 5 degrees, more preferably less than 2 degrees, most preferably less than 1 degree.

BRIEF DESCRIPTION OF THE DRAWINGS

The invention will now be described in a non-limiting way by reference to the accompanying drawings in which like parts are indicated by like reference symbols and in which.

DETAILED DESCRIPTION OF THE INVENTION

Figure 1:
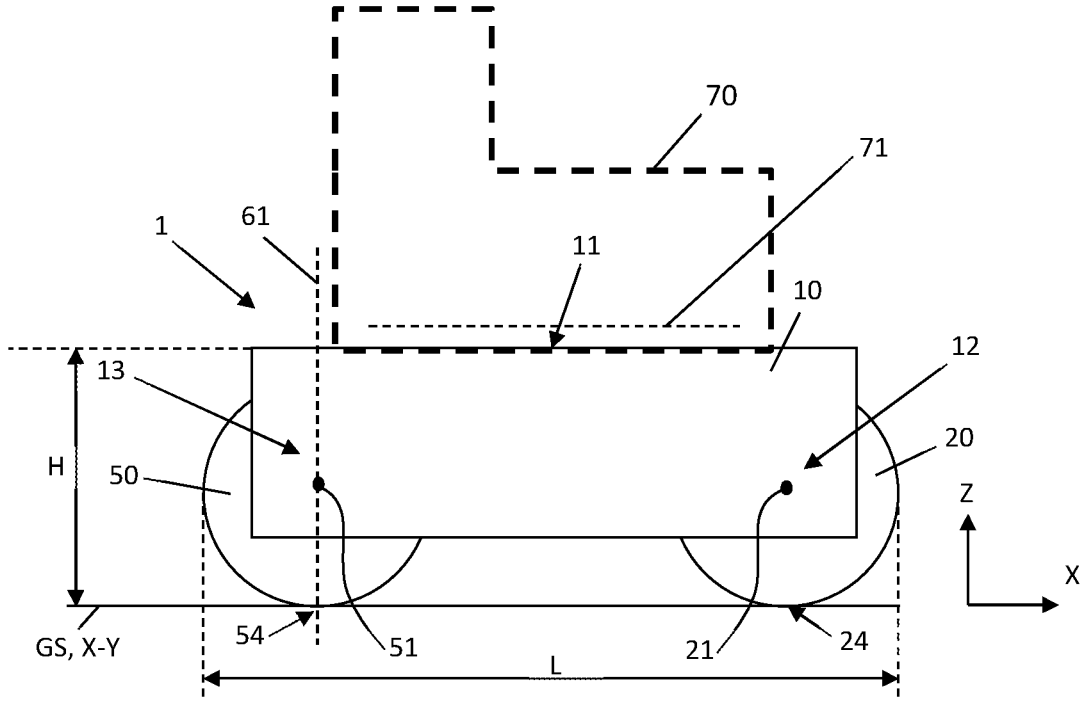
FIG. 1 schematically depicts a side view of a wheel assembly for an inline skate according to an embodiment of the invention.

FIG. 1 schematically depicts a side view of a wheel assembly 1 for an inline skate according to an embodiment of the invention.

The wheel assembly 1 comprises a frame 10 including a set of wheels with a front wheel 20 and a rear wheel 50.

The frame 10 comprises a shoe mount 11 for mounting a skate shoe 70 (shown in phantom) to the frame 10 thereby forming an inline skate. The frame 10 further comprises a front wheel mount 12 for holding the front wheel 20 and a rear wheel mount 13 or holding the rear wheel 50. The wheel assembly 1 in FIG. 1 is shown in assembled state in which the front wheel 20 is held by the front wheel mount 12 and the rear wheel 50 is held by the rear wheel 13. As known in the art, the front wheel 20 and the rear wheel 50 may be releasably mounted to the frame e.g. for maintenance or to replace wheels that are worn due to extensive or prolonged use. Hence, the wheel assembly 1 may also have an unassembled state in which the frame 10 and wheels are separate from each other.

Shown in FIG. 1 is a Cartesian coordinate system having an X-direction, a Y-direction and a Z-direction, the X-direction and the Z-direction being indicated in FIG. 1 and the Y-direction being orthogonal to both the X- and Z-direction and thus perpendicular to the plane of the drawing. The location and orientation of the Cartesian coordinate system is chosen such that an X-Y plane of the Cartesian coordinate system is tangent to both the front wheel 20 and the rear wheel 50 at or near contact patches of the front wheel and the rear wheel where the front wheel and the rear wheel are intended to engage with a ground surface GS during use. The wheel assembly 1 is arranged on the ground surface GS, such that the ground surface GS coincides with the X-Y plane. The X-Y plane is the plane spanned by the X-axis and the Y-axis extending from an origin of the Cartesian coordinate system in the X-direction and the Y-direction, respectively, as is generally known to a skilled person.

In assembled state, the wheel assembly 1 has a length L in the X-direction, a width W (shown in FIG. 7) in the Y-direction and a height H in the Z-direction.

A first aspect of the invention is based on the insight that the wheels in the set of wheels have a specific mutual orientation as will be explained below using different wheel arrangements as examples thereof.

Figure 2:
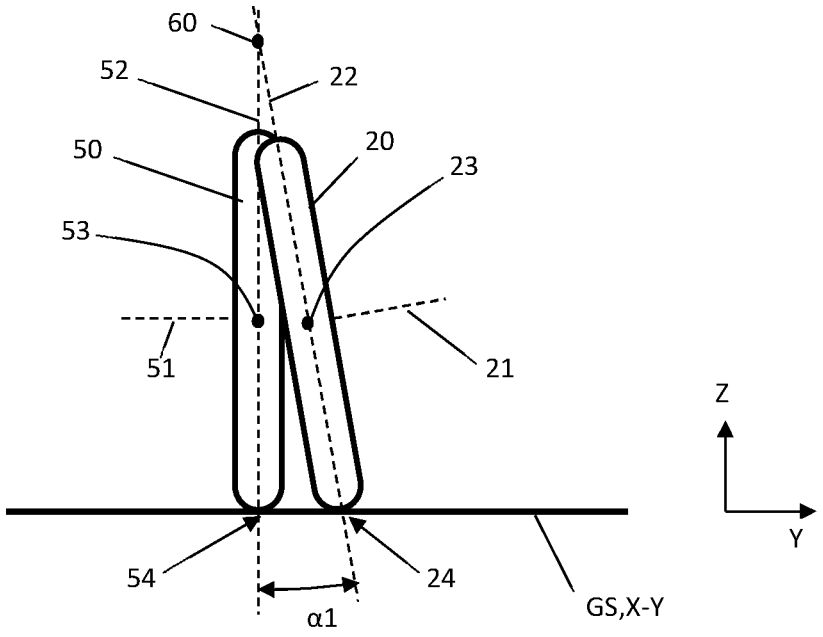
FIG. 2 schematically depicts a front plan view of the wheel assembly of FIG. 1 with a first wheel arrangement.

A first wheel arrangement is schematically depicted in FIG. 2. FIG. 2 is a front plan view of the front wheel 20 and the rear wheel 50 only. The frame 10 has been omitted in FIG. 2 to keep the drawing as simple as possible.

FIG. 2 clearly shows that the front wheel 20 has a front wheel rotation axis 21 and a front wheel rotation plane 22 extending perpendicular to the front wheel rotation axis 21 and through a center 23 of the front wheel 20. The rear wheel 50 similarly has a rear wheel rotation axis 51 and a rear wheel rotation plane 52 extending perpendicular to the rear wheel rotation axis 51 and through a center 53 of the rear wheel 50.

As mentioned before, the orientations of the wheel assembly 1 and the different wheel arrangements is such that the ground surface GS and the X-Y plane coincide. In an embodiment, this orientation corresponds to a foot supporting surface 71 of the skate shoe 70 for supporting a foot of a user being substantially perpendicular to the Z-direction. In this embodiment, the rear wheel 50 and thus the rear wheel rotation plane 52 is oriented parallel to the Z-X plane while the front wheel 20 and thus the front wheel rotation plane 22 makes an angle $\alpha 1$ with the rear wheel rotation plane 52. In this embodiment, the front wheel rotation plane 22 and the rear wheel rotation plane 52 may extend parallel to the X-direction, but the front wheel rotation plane 22 may also be oriented such that a rolling direction of the front wheel 20 over the plane ground surface GS when the X-Y plane of the wheel assembly is parallel to said ground surface is in the X-direction, which in practice may mean that the front wheel rotation plane 22 makes a non-zero angle about the Z-direction relative to the X-direction.

Due to the different orientations of the front wheel 20 and the rear wheel 50, the front wheel rotation plane 22 and the rear wheel rotation plane 52 have an intersection line 60, in this embodiment also extending parallel to the X-direction, i.e. parallel to the X-Y plane. The front wheel 20 and the rear wheel 50 have been arranged such that the intersection line 60 is located at a frame side of the X-Y plane, i.e. at a distance from the X-Y plane above the ground surface GS in FIG. 2.

Although in this example, the entire intersection line 60 may be at the frame side of the X-Y plane, the front wheel rotation plane and the rear wheel rotation plane may have a different orientation, i.e. the rotation planes do not extend in the same direction as mentioned above, such that the intersection line 60 is no longer extending parallel to the X-Y plane. However, the mutual orientation of the wheels is then still in accordance with the first aspect of the invention as long as the intersection line 60 seen in a plane 61 extending through the center 53 of the rear wheel 50, which plane 61 is parallel to a Z-Y plane of the Cartesian coordinate system, is located at the frame side of the X-Y plane.

Figure 3:
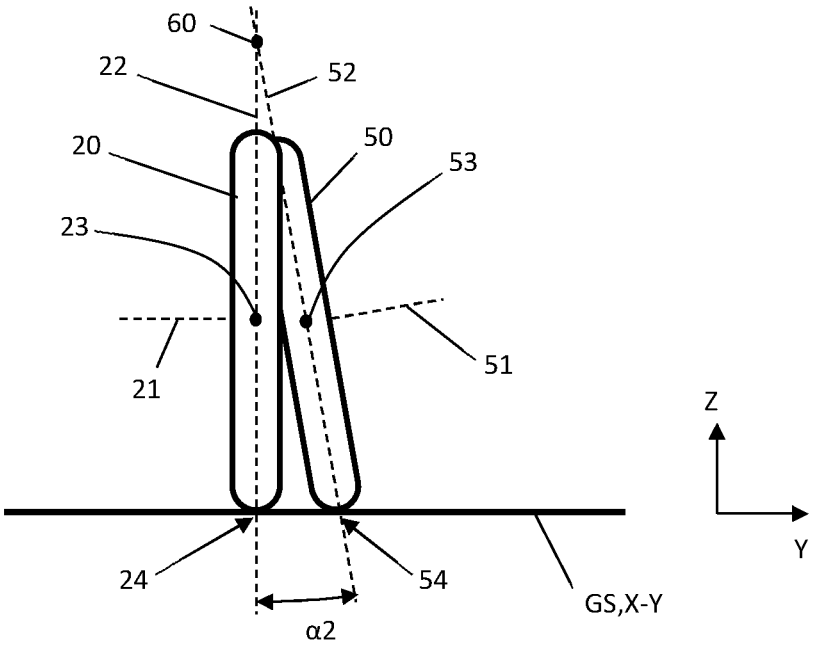
FIG. 3 schematically depicts a front plan view of the wheel assembly of FIG. 1 with a second wheel arrangement.

FIG. 3 schematically depicts a second wheel arrangement for the wheel assembly of FIG. 1. FIG. 3 is again a front plan view of the front wheel 20 and the rear wheel 50 only.

FIG. 3 similarly shows a front wheel rotation axis 21, a front wheel rotation plane 22 and a center 23 of the front wheel 20 as well as a rear wheel rotation axis 51, a rear wheel rotation plane 52, and a center 53 of the rear wheel 50.

Again, the ground surface GS and the X-Y plane coincide. In an embodiment, the orientation corresponds to a foot supporting surface 71 of the skate shoe 70 being substantially perpendicular to the Z-direction. In this embodiment, the front wheel 20 and thus the front wheel rotation plane 22 is oriented parallel to the Z-X plane while the rear wheel 50 and thus the rear wheel rotation plane 52 makes an angle $\alpha 2$ with the front wheel rotation plane 22. In this embodiment, the front wheel rotation axis 22 and the rear wheel rotation axis 52 may extend parallel to the X-direction, but the rear wheel rotation plane 52 may also be oriented such that a rolling direction of the rear wheel 50 over the plane ground surface GS when the X-Y plane of the wheel assembly is parallel to said ground surface is in the X-direction, which in practice may mean that the rear wheel rotation plane 52 makes a non-zero angle about the Z-direction relative to the X-direction.

Due to the different orientations of the front wheel 20 and the rear wheel 50, the front wheel rotation plane 22 and the rear wheel rotation plane 52 have an intersection line 60, in this embodiment also extending parallel to the X-direction, i.e. parallel to the X-Y plane.

The front wheel 20 and the rear wheel 50 have been arranged such that the intersection line 60 is located at a frame side of the X-Y plane, i.e. at a distance from the X-Y plane above the ground surface GS in FIG. 3.

Figure 4:
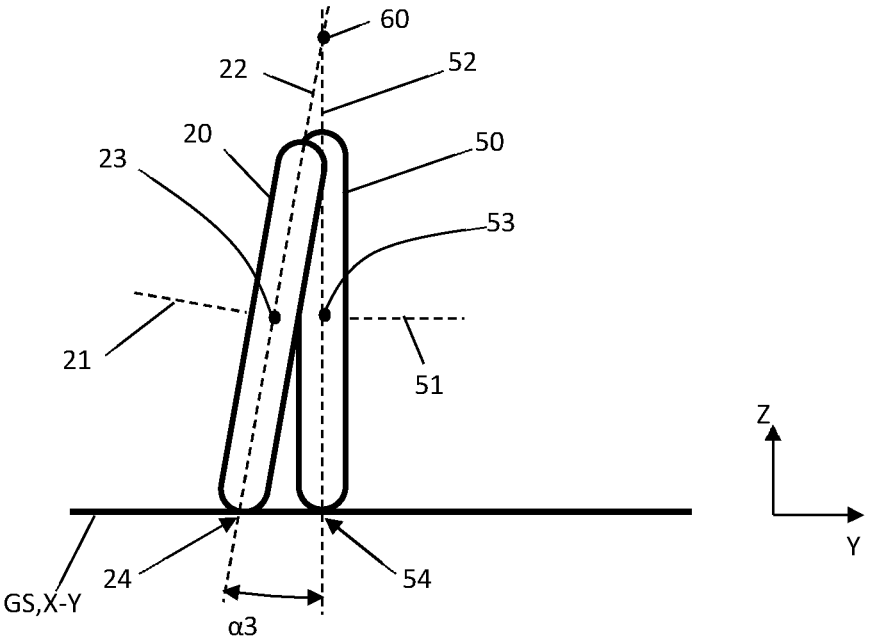
FIG. 4 schematically depicts a front plan view of the wheel assembly of FIG. 1 with a third wheel arrangement.

FIG. 4 schematically depicts a third wheel arrangement for the wheel assembly of FIG. 1. FIG. 4 is again a front plan view of the front wheel 20 and the rear wheel 50 only.

FIG. 4 similarly shows a front wheel rotation axis 21, a front wheel rotation plane 22 and a center 23 of the front wheel 20 as well as a rear wheel rotation axis 51, a rear wheel rotation plane 52, and a center 53 of the rear wheel 50.

Again, the ground surface GS and the X-Y plane coincide. In an embodiment, the orientation corresponds to a foot supporting surface 71 of the skate shoe 70 being substantially perpendicular to the Z-direction. In this embodiment, the rear wheel 50 and thus the rear wheel rotation plane 52 is oriented parallel to the Z-X plane while the front wheel 20 and thus the front wheel rotation plane 22 makes an angle $\alpha 3$ with the rear wheel rotation plane 52. In this embodiment, the front wheel rotation axis 22 and the rear wheel rotation axis 52 may extend parallel to the X-direction, but the front wheel rotation plane 22 may also be oriented such that a rolling direction of the front wheel 20 over the plane ground surface GS when the X-Y plane of the wheel assembly is parallel to said ground surface is in the X-direction, which in practice may mean that the front wheel rotation plane 22 makes a non-zero angle about the Z-direction relative to the X-direction.

Due to the different orientations of the front wheel 20 and the rear wheel 50, the front wheel rotation plane 22 and the rear wheel rotation plane 52 have an intersection line 60, in this embodiment also extending parallel to the X-direction, i.e. parallel to the X-Y plane. The front wheel 20 and the rear wheel 50 have been arranged such that the intersection line 60 is located at a frame side of the X-Y plane, i.e. at a distance from the X-Y plane above the ground surface GS in FIG. 4.

Figure 5:
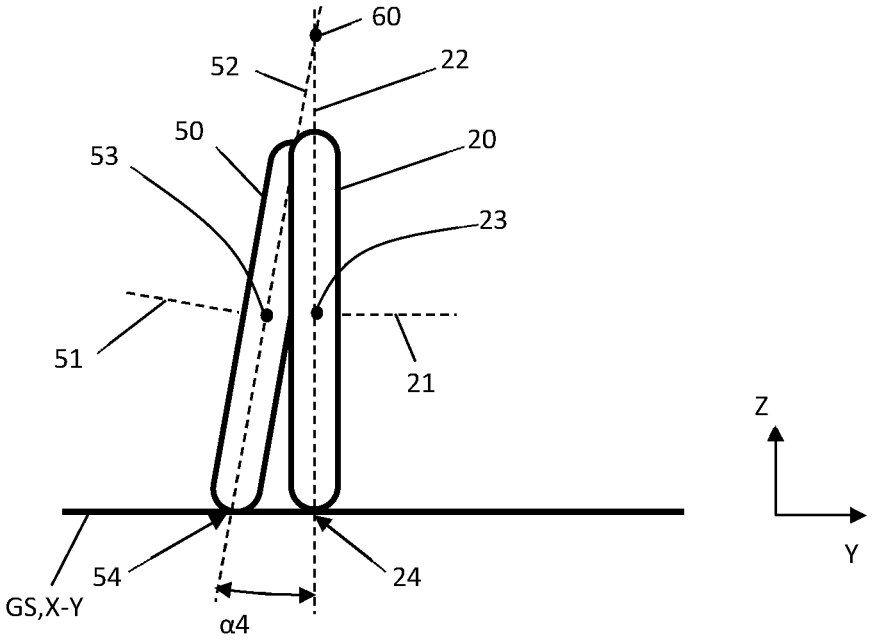
FIG. 5 schematically depicts a front plan view of the wheel assembly of FIG. 1 with a fourth wheel arrangement.

FIG. 5 schematically depicts a fourth wheel arrangement for the wheel assembly of FIG. 1. FIG. 5 is again a front plan view of the front wheel 20 and the rear wheel 50 only.

FIG. 5 similarly shows a front wheel rotation axis 21, a front wheel rotation plane 22 and a center 23 of the front wheel 20 as well as a rear wheel rotation axis 51, a rear wheel rotation plane 52, and a center 53 of the rear wheel 50.

Again, the ground surface GS and the X-Y plane coincide. In an embodiment, the orientation corresponds to a foot supporting surface 71 of the skate shoe 70 being substantially perpendicular to the Z-direction. In this embodiment, the front wheel 20 and thus the front wheel rotation plane 22 is oriented parallel to the Z-X plane while the rear wheel 50 and thus the rear wheel rotation plane 52 makes an angle $\alpha 4$ with the front wheel rotation plane 22. In this embodiment, the front wheel rotation axis 22 and the rear wheel rotation axis 52 may extend parallel to the X-direction, but the rear wheel rotation plane 52 may also be oriented such that a rolling direction of the rear wheel 50 over the plane ground surface GS when the X-Y plane of the wheel assembly is parallel to said ground surface is in the X-direction, which in practice may mean that the rear wheel rotation plane 52 makes a non-zero angle about the Z-direction relative to the X-direction.

Due to the different orientations of the front wheel 20 and the rear wheel 50, the front wheel rotation plane 22 and the rear wheel rotation plane 52 have an intersection line 60, in this embodiment also extending parallel to the X-direction, i.e. parallel to the X-Y plane. The front wheel 20 and the rear wheel 50 have been arranged such that the intersection line 60 is located at a frame side of the X-Y plane, i.e. at a distance from the X-Y plane above the ground surface GS in FIG. 5.

The above first to fourth wheel arrangements have in common that in the shown orientations one of the wheels is parallel to the Z-X plane. The first and the fourth wheel arrangement have in common that in the shown front plan view the front wheel rotation plane 22 makes an acute angle $\alpha 1$ and $\alpha 4$, respectively, in the counterclockwise direction with respect to the rear wheel rotation plane 52. Likewise, the second and third wheel arrangement have in common that in the shown front plan view the front wheel rotation plane 22 makes an acute angle $\alpha 2$ and $\alpha 3$, respectively, in the clockwise direction with respect to the rear wheel rotation plane 52.

Although in the first to fourth wheel arrangements, one of the wheels is parallel to the Z-X plane, it is also possible that all wheels have the same positive or negative camber angle.

In an embodiment, a combination of two wheel assemblies 1 according to the first aspect of the invention is provided, one of the wheel assemblies 1 being configured for a left inline skate and the other one being configured for a right inline skate. It is then envisaged that the wheel arrangements associated with the two wheel assemblies 1 are mirror images of each other. Hence, one of the wheel assemblies 1 may be provided with a wheel arrangement in accordance with the first wheel arrangement of FIG. 2 and the other wheel assembly 1 may be provided with a wheel arrangement in accordance with the third wheel arrangement of FIG. 4. In another embodiment, one of the wheel assemblies 1 may be provided with a wheel arrangement in accordance with the second wheel arrangement of FIG. 3 and the other wheel assembly 1 may be provided with a wheel arrangement in accordance with the fourth wheel arrangement of FIG. 5.

Figure 6:
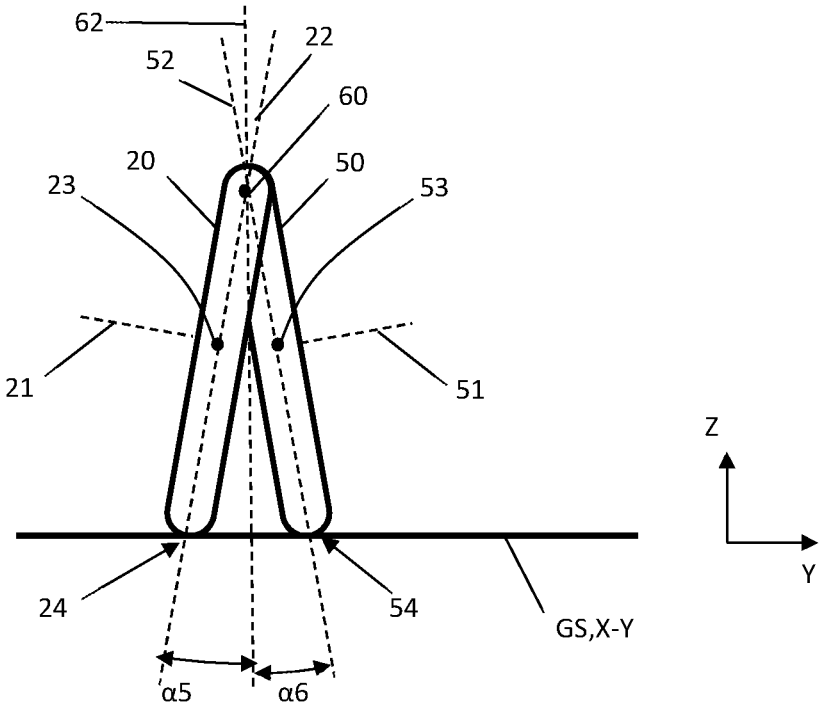
FIG. 6 schematically depicts a front plan view of the wheel assembly of FIG. 1 with a fifth wheel arrangement.

FIG. 6 schematically depicts a fifth wheel arrangement for the wheel assembly of FIG. 1. FIG. 6 is again a front plan view of the front wheel 20 and the rear wheel 50 only.

FIG. 6 similarly shows a front wheel rotation axis 21, a front wheel rotation plane 22 and a center 23 of the front wheel 20 as well as a rear wheel rotation axis 51, a rear wheel rotation plane 52, and a center 53 of the rear wheel 50.

Again, the ground surface GS and the X-Y plane coincide. In an embodiment, the orientation corresponds to a foot supporting surface 71 of the skate shoe 70 being substantially perpendicular to the Z-direction. In this embodiment, a plane 62 is indicated that is parallel to the Z-X plane. None of the front wheel 20 and the rear wheel 50 are parallel to this plane 62. The front wheel rotation plane 22 makes an acute angle $\alpha 5$ relative to the plane 62 while the rear wheel rotation plane 52 makes an acute angle $\alpha 6$ relative to the plane 62 such that the front wheel rotation plane 22 and the rear wheel rotation plane 52 extend at opposite sides of the plane 62 except at the location of the intersection line 60. The front wheel rotation plane 22 and the rear wheel rotation plane 52 may extend parallel to the X-direction so that the intersection line 60 is also extending parallel to the X-direction, i.e. parallel to the X-Y plane. The front wheel 20 and the rear wheel 50 have been arranged such that the intersection line 60 is located at a frame side of the X-Y plane, i.e. at a distance from the X-Y plane above the ground surface GS in FIG. 6. However, the front wheel rotation plane 22 and the rear wheel rotation plane 52 may also be oriented such that a rolling direction of the front wheel 20 and a rolling direction of the rear wheel 50 over the plane ground surface GS when the X-Y plane of the wheel assembly is parallel to said ground surface are in the X-direction, which in practice may mean that the front wheel rotation plane 22 and the rear wheel rotation plane 52 make a non-zero angle about the Z-direction relative to the X-direction.

Figure 7:
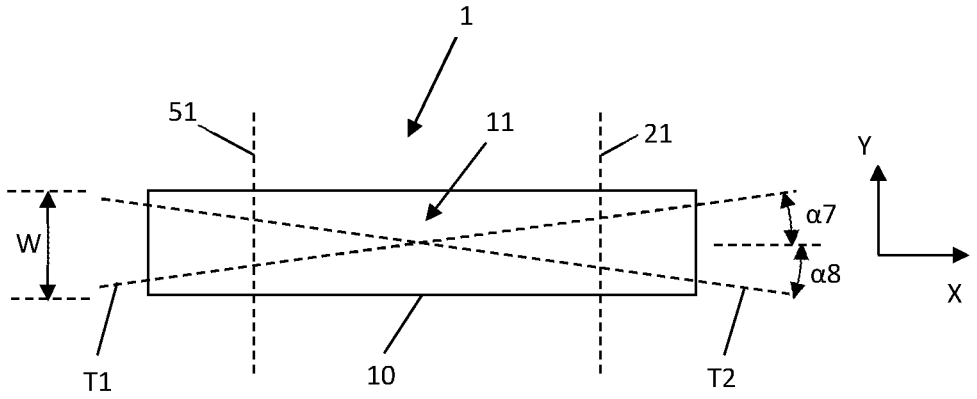
FIG. 7 schematically depicts a top plan view of the wheel assembly of FIG. 1.

FIG. 7 schematically depicts a top plan view of the wheel assembly 1 of FIG. 1. In this FIG. 7 the width W of the wheel assembly extending in the Y-direction is clearly visible. Further, the frame 10 with the skate mount 11 at the upper side thereof is depicted. The wheels are omitted in this drawing to keep the drawing as simple as possible. However, indicated are the front wheel rotation axis 21 and the rear wheel rotation axis 51. As can be clearly seen in this drawing, the front and rear wheel rotation axes 21,51, in this embodiment, extend perpendicular to the X-direction, meaning that a rolling direction of the wheels, and thus the wheel assembly, is mainly in the X-direction.

Referring to the wheel arrangements depicted in FIGS. 2-6, the front wheel 20 has a contact patch 24, which is the location on the outer circumference of the front wheel 20 that is intended to contact the ground surface GS during use. Likewise, the rear wheel 50 has a contact patch 54, which is the location on the outer circumference of the rear wheel 50 that is intended to contact the ground surface GS during use. The contact patches 24, 54 are not fixed locations as the orientation of the wheels during use may change, but are, as known in the art, limited to a corresponding contact region at a side of the respective wheel facing away from the frame 10.

The benefits of the first aspect of the invention is not only based on the mutual orientation of the wheels, i.e. front wheel 20 and rear wheel 50, but also on their mutual position compared to the rolling direction. As can be derived from the earlier described wheel arrangements, the contact patches 24, 54 in the first and fourth wheel arrangement may be disposed along a trajectory T1 making an acute angle $\alpha$7 with the rolling direction, while the contact patches 24,54 in the second and third wheel arrangements may be disposed along a trajectory T2 making an acute angle $\alpha$8 with the rolling direction. In practical embodiments, the trajectories T1 and T2 may be shifted in the Y-direction for stability reasons. As a result thereof when the wheel assembly is used in an inline skate, one of the wheels is more to the inside, i.e. the medial side of the skate shoe, than the other one of the wheel, which other one of the wheels is thus more to the outside, i.e. the lateral side of the skate shoe.

Figure 8:
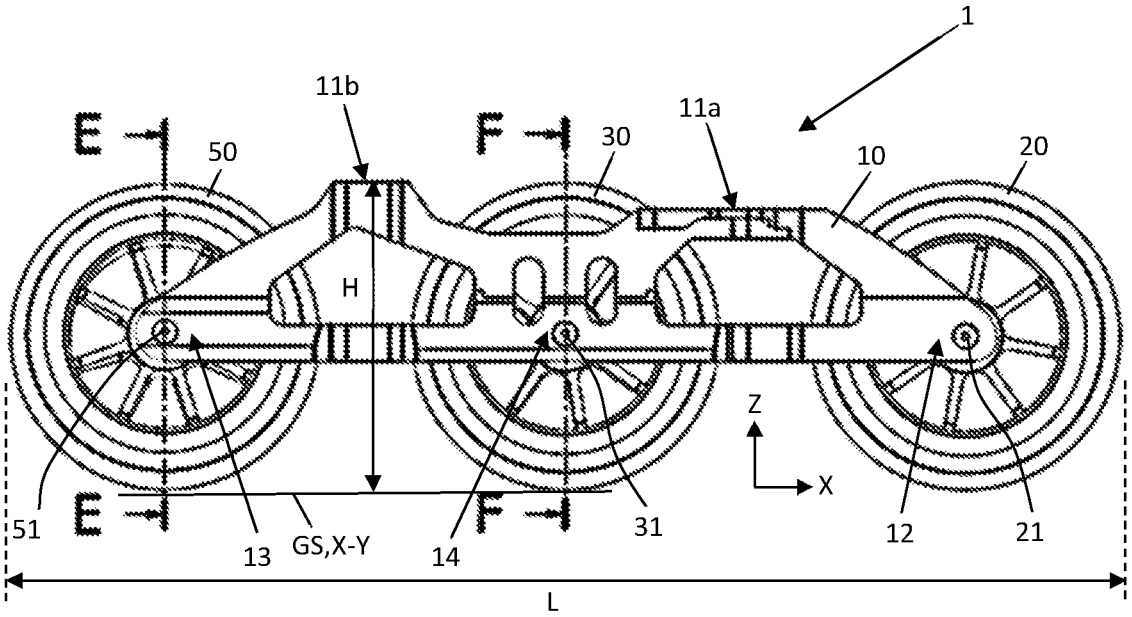
FIG. 8 schematically depicts a side view of a wheel assembly according to a practical embodiment of the invention.
Figure 9:
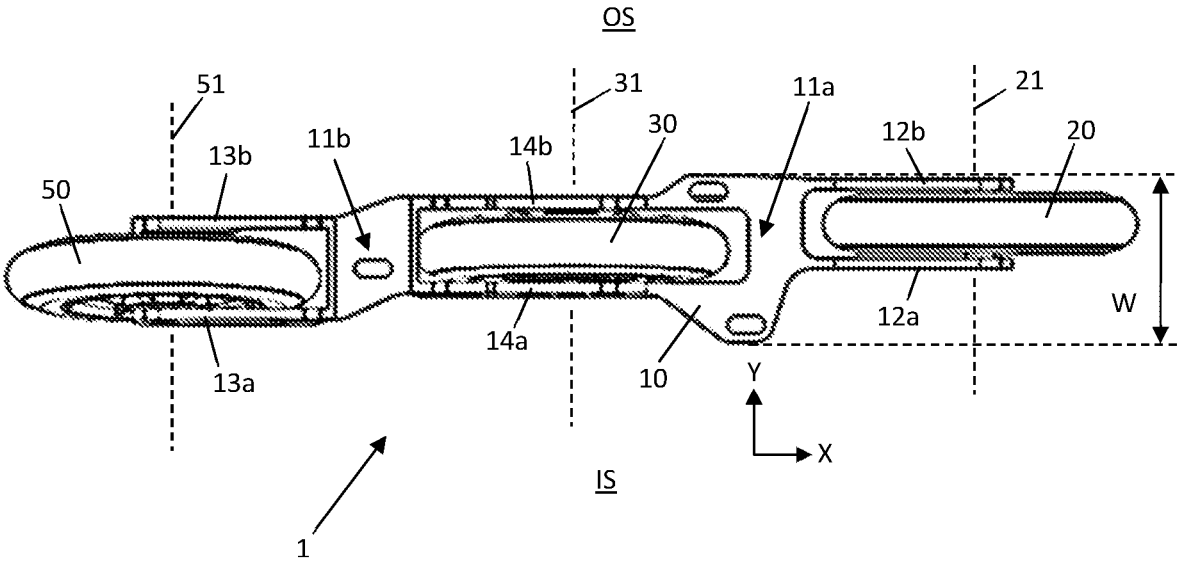
FIG. 9 schematically depicts a top plan view of the wheel assembly of FIG. 8.
Figure 10:
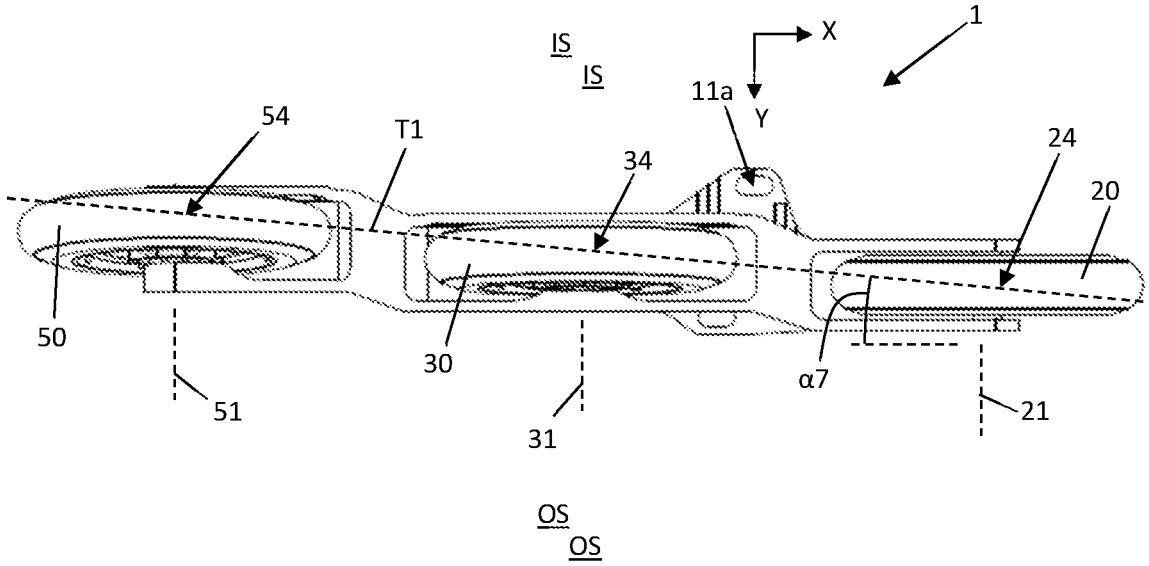
FIG. 10 schematically depicts a bottom plan view of the wheel assembly of FIG. 8.
Figure 11:
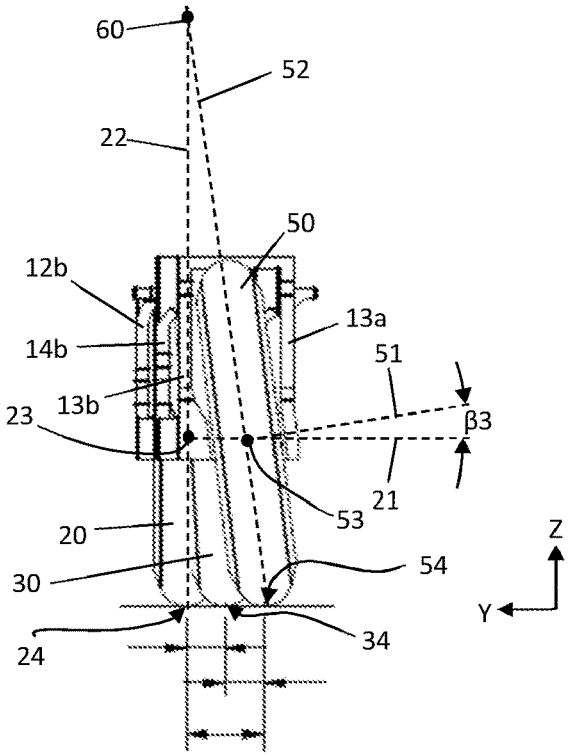
FIG. 11 schematically depicts a rear plan view of the wheel assembly of FIG. 8.
Figure 12:
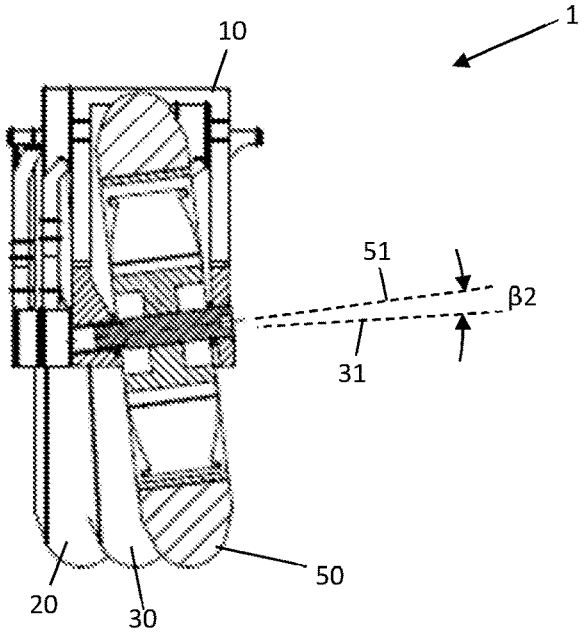
FIG. 12 schematically depicts a cross-sectional view of a cross-section indicated by line E-E in FIG. 8.
Figure 13:
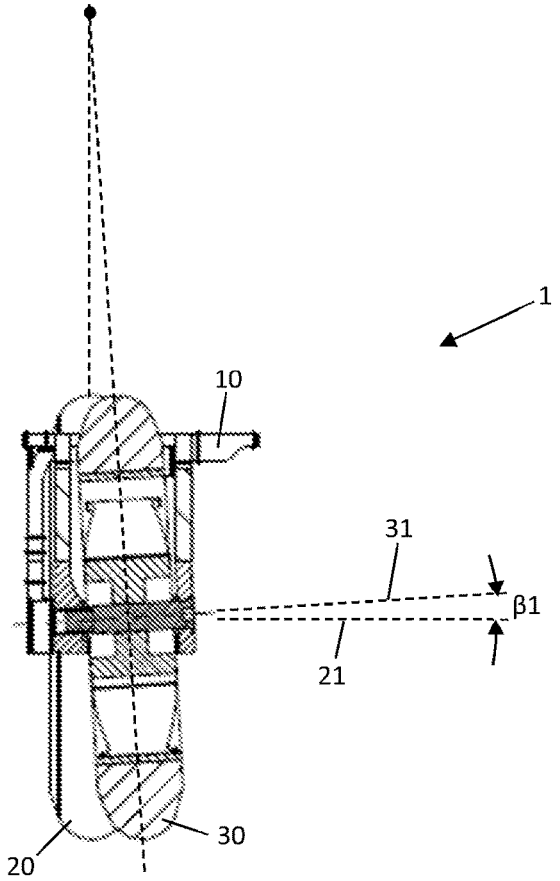
FIG. 13 schematically depicts a cross-sectional view of a cross-section indicated by line F-F in FIG. 8.

FIGS. 8-13 schematically depict a wheel assembly 1 for an inline skate according to a practical embodiment of the invention. FIG. 8 depicts a side view, FIG. 9 depicts a top plan view, FIG. 10 depicts a bottom plan view, FIG. 11 depicts a rear plan view, FIG. 12 depicts a cross-sectional view and FIG. 13 depicts another cross-sectional view.

The wheel assembly 1 comprises a frame 10 and a set of wheels including a front wheel 20, a middle wheel 30 and a rear wheel 50, said middle wheel 30 being arranged between the front wheel 20 and the rear wheel 50.

A Cartesian coordinate system is defined such that a length L of the wheel assembly 1 extends in an X-direction, the width W of the wheel assembly 1 extends in a Y-direction, and the height H of the wheel assembly 1 extends in a Z-direction with the X-Y plane being tangent to the set of wheels at a side of the wheels intended to contact the ground surface GS during use.

The frame 10 comprises a shoe mount including a first mounting location 11*a* and a second mounting location 11*b* to mount a skate shoe (not shown) to the frame 10.

The frame 10 further comprises a front wheel mount 12, a middle wheel mount 14 and a rear wheel mount 13, respectively defining a front wheel rotation axis 21 for the front wheel 20, a middle wheel rotation axis 31 for the middle wheel 30, and a rear wheel rotation axis 51 for the rear wheel 50.

The front wheel rotation axis 21, the middle wheel rotation axis 31 and the rear wheel rotation axis 51 have in common that they are perpendicular to a longitudinal direction of the wheel assembly 1, which longitudinal direction is in this embodiment parallel to the X-direction.

It is noted that the wheel assembly 1 depicted in the drawings is for a left skate shoe so that the wheel assembly 1 has an inner side IS and an outer side OS, the inner side IS being configured to face towards the other inline skate, i.e. the right skate shoe in this example, and the outer side OS being configured to face away from the other inline skate. The inside IS of the wheel assembly 1 corresponds to a medial side of the skate shoe or foot and thus may alternatively be referred to as medial side. Similarly, the outside OS of the wheel assembly 1 corresponds to a lateral side of the skate shoe or foot and thus may alternatively be referred to as lateral side.

The front wheel mount 12 is formed by a side wall 12*a* at the inside IS of the wheel assembly and a side wall 12*b* at the outside OS of the wheel assembly, where the front wheel 20 is to be received in between the two side walls 12*a*, 12*b*.

The middle wheel mount 14 is formed by a side wall 14*a* at the inside IS of the wheel assembly and a side wall 14*b* at the outside OS of the wheel assembly, where the middle wheel 30 is to be received in between the two side walls 14*a*, 14*b*.

The rear wheel mount 13 is formed by a side wall 13*a* at the inside IS of the wheel assembly and a side wall 13*b* at the outside OS of the wheel assembly, where the rear wheel 40 is to be received in between the two side walls 13*a*, 13*b*.

Each wheel 20, 30, 50 has an associated contact patch 24, 34, 54 as clearly depicted in FIGS. 10 and 11, which is configured to contact the ground surface GS. The contact patch is not a fixed location on the wheel as the wheel rotates about its rotation axis and thus different areas on the wheel's outer circumference make contact with the ground upon rotation. Also, the wheel assembly may be inclined inwards or outwards during use and thus the contact patch may shift sideways over the outer circumference during use.

However, in any case, the contact patches 24, 34, 54 of the set of wheels are disposed along an imaginary substantially straight trajectory T1 as indicated in FIG. 10. In other words, the contact patches are located on an imaginary straight trajectory T1 seen in top plan view or in bottom plan view extending between the contact patch 54 of the rear wheel 50 and the contact patch 24 of the front wheel 20.

The trajectory T1 makes an acute angle $\alpha$7 with the longitudinal direction, i.e. the X-direction such that the contact patch 54 of the rear wheel 50 is located more to the inside IS of the wheel assembly than the contact patch 24 of the front wheel 20. The angle α7 is preferably in the range of 0-15 degrees.

FIGS. 11, 12 and 13 are drawings of the wheel assembly viewed in the longitudinal direction, i.e. the X-direction. From these drawings it follows that an orientation of the middle wheel rotation axis 31 about the X-direction is at a first angle β1 with an orientation of the front wheel rotation axis 21 about the X-direction. Further, an orientation of the rear wheel rotation axis 51 is at a second angle β2 with the orientation of the middle wheel rotation axis 31. As a result thereof, the orientation of the rear wheel rotation axis 51 about the X-direction is at a third angle β3 with the orientation of the front wheel rotation axis 21 about the X-direction, where $\beta 3=|\beta 1|+|\beta 2|$.

The result for this embodiment is that a lower half of the rear wheel 50 is inclined towards the inside IS of the wheel assembly 1 compared to a lower half of the front wheel 20, and that a lower half of the middle wheel 30 is inclined towards the inside IS of the wheel assembly 1 compared to the lower half of the front wheel 20.

Preferably, β3 is in the range of 0-15 degrees, preferably 5-9 degrees, more preferably 6-8 degrees and most preferably 7 degrees.

In the rear plan view of FIG. 11 and the cross-sectional views in the same direction of FIGS. 12-13, the orientation of the middle wheel rotation axis 31 about the X-direction is rotated counterclockwise through the first angle β1 relative to the orientation of the front wheel rotation axis 21 about the X-direction. Similarly, the orientation of the rear wheel rotation axis 51 about the X-direction is rotated counterclockwise through the second angle β2 relative to the orientation of the middle wheel rotation axis 31 about the X-direction. As a result thereof, the orientation of the rear wheel rotation axis 51 about the X-direction is rotated counterclockwise through the third angle β3 relative to the orientation of the front wheel rotation axis 21 about the X-direction.

Although not shown, a similar wheel assembly for a right skate shoe can be provided, wherein the wheel assembly for the right skate shoe is mirror symmetric to the wheel assembly of the shown left skate shoe. The right wheel assembly then has, in the rear plan view, an orientation of the middle wheel rotation axis about the longitudinal direction being rotated clockwise through a first angle β1 relative to an orientation of the front wheel rotation axis about said longitudinal direction. Similarly, an orientation of the rear wheel rotation axis about sais longitudinal direction is rotated clockwise through a second angle β2 relative to the orientation of the middle wheel rotation axis about sais longitudinal direction.

Generally speaking, it is preferred that a ratio between the first angle β1 and the second angle β2 is equal to a ratio between a distance between the middle wheel rotation axis 31 and the front wheel rotation axis 21 and a distance between the middle wheel rotation axis 31 and the rear wheel rotation axis 51. In the embodiment of FIGS. 8-13, the middle wheel rotation axis 31 is equidistant to the front wheel rotation axis 21 and the rear wheel rotation axis 51 so that $\beta 1=\beta 2=\frac{1}{2}*\beta 3$.

Figure 14:
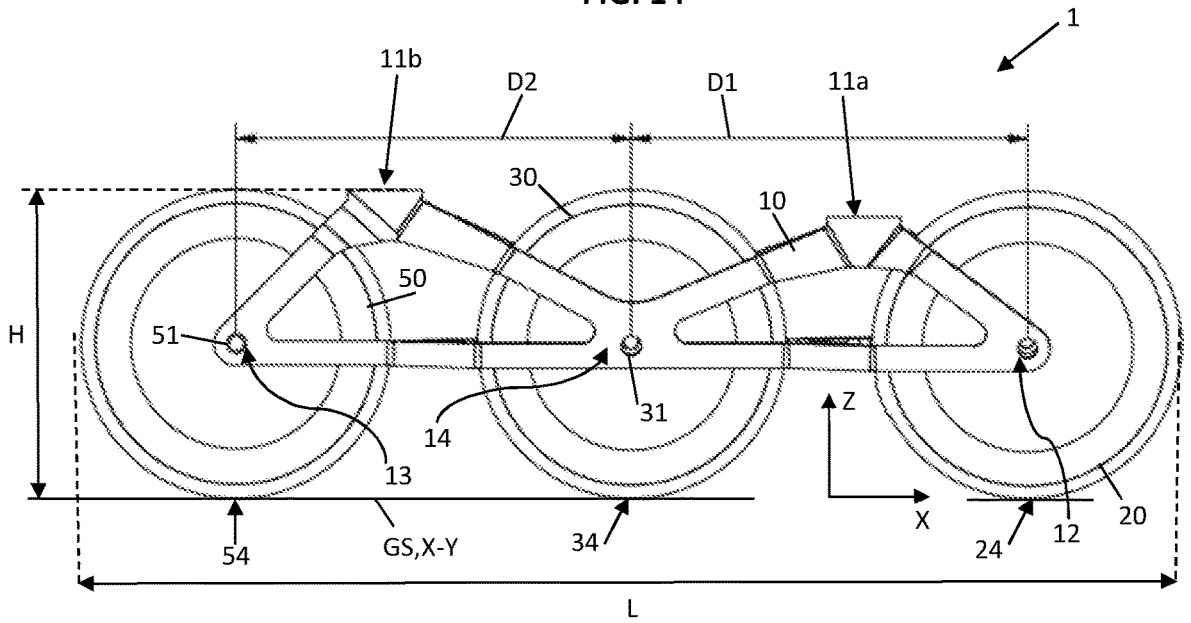
FIG. 14 schematically depicts a side view of a wheel assembly according to another practical embodiment of the invention.
Figure 15:
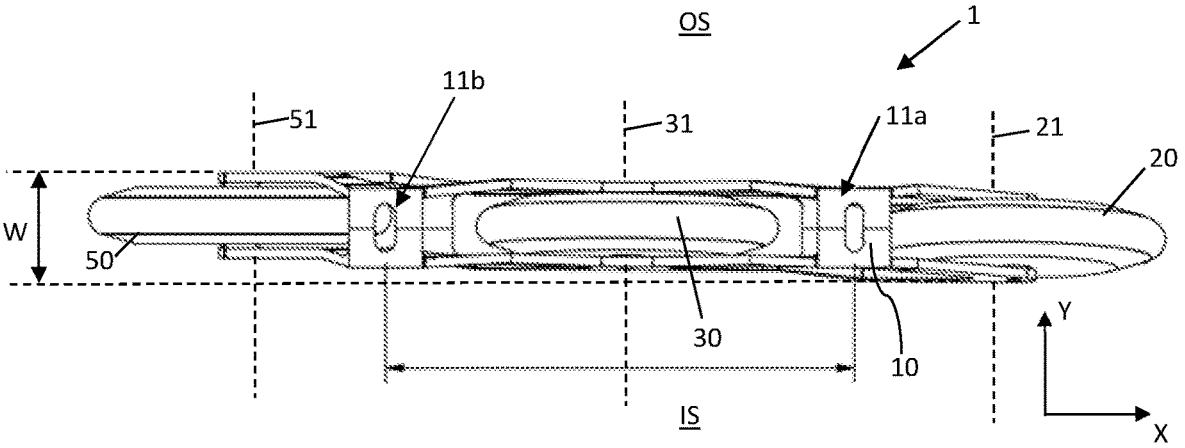
FIG. 15 schematically depicts a top plan view of the wheel assembly of FIG. 14.
Figure 16:
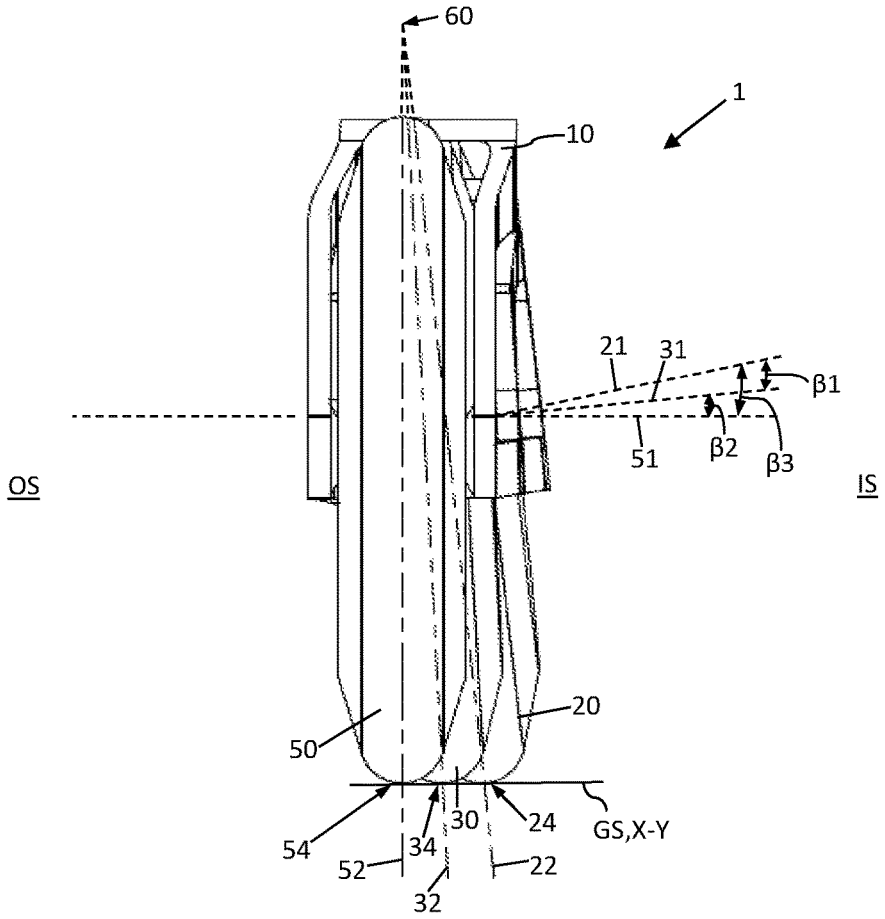
FIG. 16 schematically depicts a rear plan view of the wheel assembly of FIG. 14.
Figure 17:
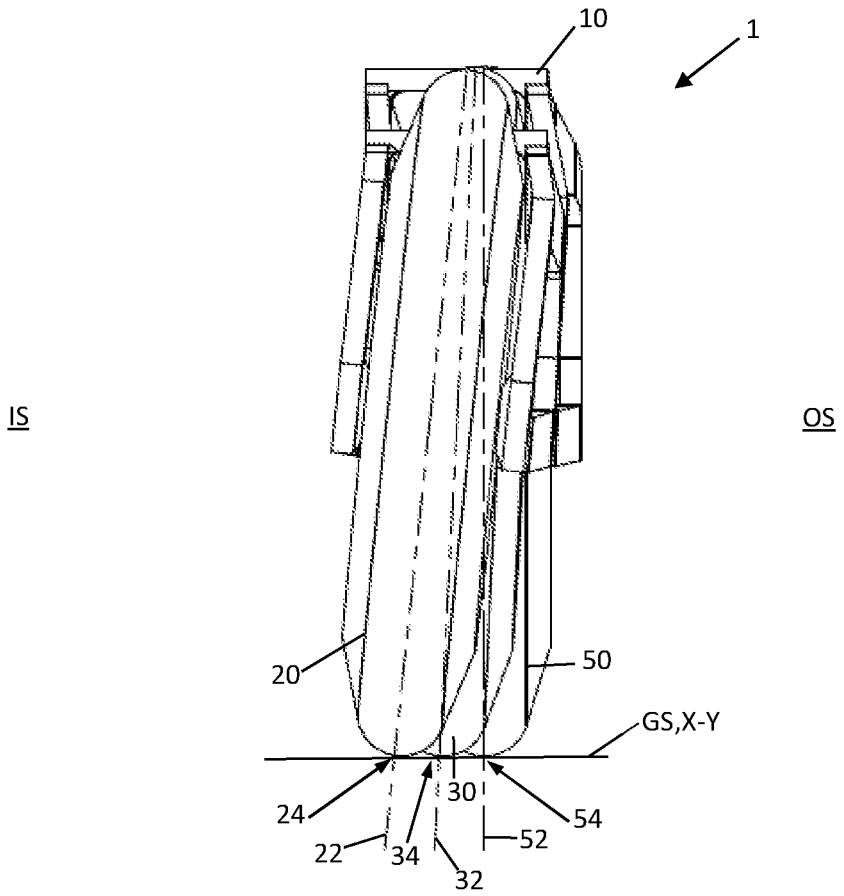
FIG. 17 schematically depicts a front plan view of the wheel assembly of FIG. 14.

FIGS. 14-17 schematically depict a wheel assembly 1 for an inline skate according to another practical embodiment of the invention. FIG. 14 depicts a side view, FIG. 15 depicts a top plan view, FIG. 16 depicts a rear plan view and FIG. 17 depicts a front plan view.

The wheel assembly 1 comprises a frame 10 and a set of wheels including a front wheel 20, a middle wheel 30 and a rear wheel 50, said middle wheel 30 being arranged between the front wheel 20 and the rear wheel 50.

A Cartesian coordinate system is defined such that a length L of the wheel assembly 1 extends in an X-direction, the width W of the wheel assembly 1 extends in a Y-direction, and the height H of the wheel assembly 1 extends in a Z-direction with the X-Y plane being tangent to the set of wheels at a side of the wheels intended to contact the ground surface GS during use.

The frame 10 comprises a shoe mount including a first mounting location 11*a* and a second mounting location 11*b* to mount a skate shoe (not shown) to the frame 10.

The frame 10 further comprises a front wheel mount 12, a middle wheel mount 14 and a rear wheel mount 13, respectively defining a front wheel rotation axis 21 for the front wheel 20, a middle wheel rotation axis 31 for the middle wheel 30, and a rear wheel rotation axis 51 for the rear wheel 50.

The front wheel rotation axis 21, the middle wheel rotation axis 31 and the rear wheel rotation axis 51 have in common that they are perpendicular to a longitudinal direction of the wheel assembly 1, which longitudinal direction is in this embodiment parallel to the X-direction.

It is noted that the wheel assembly 1 depicted in the drawings is for a left skate shoe so that the wheel assembly 1 has an inner side IS and an outer side OS, the inner side IS being configured to face towards the other inline skate, i.e. the right skate shoe in this example, and the outer side OS being configured to face away from the other inline skate. The inside IS of the wheel assembly 1 corresponds to a medial side of the skate shoe or foot and thus may alternatively be referred to as medial side. Similarly, the outside OS of the wheel assembly 1 corresponds to a lateral side of the skate shoe or foot and thus may alternatively be referred to as lateral side.

Each wheel 20, 30, 50 has an associated contact patch 24, 34, 54, which is configured to contact the ground surface GS. The contact patch is not a fixed location on the wheel as the wheel rotates about its rotation axis and thus different areas on the wheel's outer circumference make contact with the ground upon rotation. Also, the wheel assembly may be inclined inwards or outwards during use and thus the contact patch may shift sideways over the outer circumference during use. However, in any case, the contact patches 24, 34, 54 of the set of wheels are disposed along an imaginary substantially straight trajectory having an orientation similar to the imaginary straight trajectory T2 shown in FIG. 7. In other words, the contact patches are located on an imaginary straight trajectory T2 seen in top plan view or in bottom plan view extending between the contact patch 54 of the rear wheel 50 and the contact patch 24 of the front wheel 20. It is noted here that the orientation of the imaginary straight trajectory is one of the major differences with the embodiment of FIGS. 8-13, where the imaginary straight trajectory corresponds to the trajectory T1 in FIG. 7.

The trajectory T2 makes an acute angle α8 with the longitudinal direction, i.e. the X-direction such that the contact patch 54 of the rear wheel 50 is located more to the outside IS of the wheel assembly than the contact patch 24 of the front wheel 20. The angle α8 is preferably in the range of 0-15 degrees.

FIGS. 16 and 17 are drawings of the wheel assembly viewed in the longitudinal direction, i.e. the X-direction. From these drawings it follows that an orientation of the middle wheel rotation axis 31 about the X-direction is at a first angle β1 with an orientation of the front wheel rotation axis 21 about the X-direction. Further, an orientation of the rear wheel rotation axis 51 is at a second angle β2 with the orientation of the middle wheel rotation axis 31. As a result thereof, the orientation of the rear wheel rotation axis 51 about the X-direction is at a third angle β3 with the orientation of the front wheel rotation axis 21 about the X-direction, where $\beta 3=|\beta 1|+|\beta 2|$.

The result for this embodiment is that a lower half of the front wheel 20 is inclined towards the inside IS of the wheel assembly 1 compared to a lower half of the rear wheel 50, and that a lower half of the middle wheel 30 is inclined towards the inside IS of the wheel assembly 1 compared to the lower half of the rear wheel 20.

Preferably, β3 is in the range of 0-15 degrees, preferably 4-8 degrees, more preferably 5-7 degrees and most preferably 6 degrees.

In the rear plan view of FIG. 16, the orientation of the middle wheel rotation axis 31 about the X-direction is rotated clockwise through the first angle β1 relative to the orientation of the front wheel rotation axis 21 about the X-direction. Similarly, the orientation of the rear wheel rotation axis 51 about the X-direction is rotated clockwise through the second angle β2 relative to the orientation of the middle wheel rotation axis 31 about the X-direction. As a result thereof, the orientation of the rear wheel rotation axis 51 about the X-direction is rotated clockwise through the third angle β3 relative to the orientation of the front wheel rotation axis 21 about the X-direction.

Although not shown, a similar wheel assembly for a right skate shoe can be provided, wherein the wheel assembly for the right skate shoe is mirror symmetric to the wheel assembly of the shown left skate shoe. The right wheel assembly then has, in the rear plan view, an orientation of the middle wheel rotation axis about the longitudinal direction being rotated counterclockwise through a first angle β1 relative to an orientation of the front wheel rotation axis about said longitudinal direction. Similarly, an orientation of the rear wheel rotation axis about said longitudinal direction is rotated counterclockwise through a second angle β2 relative to the orientation of the middle wheel rotation axis about said longitudinal direction.

Generally speaking, it is preferred that a ratio between the first angle β1 and the second angle β2 is equal to a ratio between a distance D1 between the middle wheel rotation axis 31 and the front wheel rotation axis 21 and a distance D2 between the middle wheel rotation axis 31 and the rear wheel rotation axis 51. In the embodiment of FIGS. 14-17, the middle wheel rotation axis 31 is equidistant to the front wheel rotation axis 21 and the rear wheel rotation axis 51 so that $\beta 1=\beta 2=\frac{1}{2}*\beta 3$.

In an embodiment, the intersection line seen in a plane extending through the center of the rear wheel parallel to a Z-Y plane of the Cartesian coordinate system is located at a frame side of the X-Y plane, wherein a distance between the intersection line and the X-Y plane in said Z-Y plane is at least half the diameter of the rear wheel, preferably at least the diameter of the rear wheel.

In an embodiment, a distance between the contact patch 24 and the contact patch 54 in the Y-direction is at least 5 mm, preferably at least 10 mm, more preferably at least 15 mm.

Figure 18:
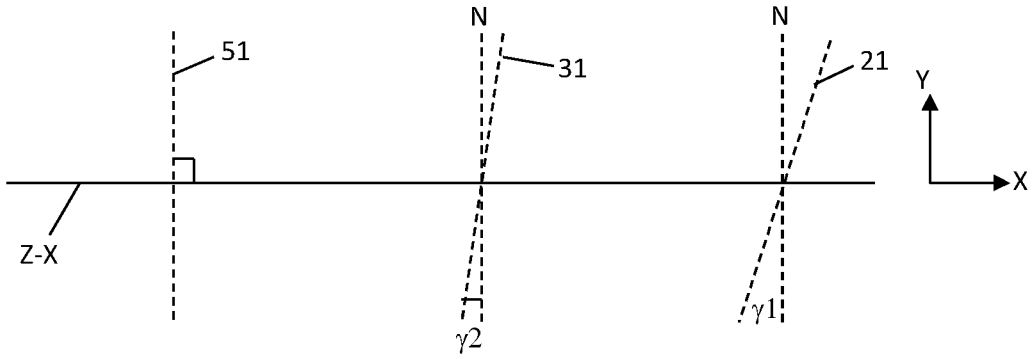
FIG. 18 schematically depicts an exaggerated view of a plan view of the rotation axes of the wheels of the wheel assembly of FIG. 14.

FIG. 18 depicts a plan view of the wheel assembly of FIG. 14 but with exaggerated dimensions and angles. Shown is the Z-X plane as a plane extending perpendicular to the foot support surface of a corresponding skate shoe mounted to the frame of the wheel assembly. With respect to this plane, both the front wheel and the middle wheel have a non-zero camber angle while the rear wheel has a zero camber angle. According to a third aspect of the invention, the rear wheel rotation axis 51 in the plan view of FIG. 18 is perpendicular to the Z-X plane, while the front wheel rotation axis 21 and the middle wheel rotation axis 31 make a non-zero angle γ1 and γ2, respectively, wherein γ1>γ2, because the camber angle of the front wheel is larger than the camber angle of the middle wheel.

Although in the above embodiments and examples, the skate shoe and frame have been described as separate elements, it is also possible that the skate shoe and frame are integrated to form a single element.

The invention claimed is:

1. A wheel assembly for an inline skate comprising:

a frame; and a set of wheels including a front wheel and a rear wheel, wherein the frame includes a shoe mount for mounting a skate shoe to the frame, a front wheel mount for holding the front wheel, and a rear wheel mount for holding the rear wheel, wherein the wheel assembly has an assembled state in which the front wheel is held by the front wheel mount and the rear wheel is held by the rear wheel mount, wherein the wheel assembly in the assembled state has a length, a width and a height extending respectively in an X-direction, a Y-direction and a Z-direction of a Cartesian coordinate system, an X-Y plane of the Cartesian coordinate system being tangent to both the front wheel and the rear wheel at or near contact patches of the front wheel and the rear wheel, wherein the front wheel has a front wheel rotation axis and a front wheel rotation plane extending perpendicular to the front wheel rotation axis and through a center of the front wheel, wherein the rear wheel has a rear wheel rotation axis and a rear wheel rotation plane extending perpendicular to the rear wheel rotation axis and through a center of the rear wheel, wherein in the assembled state of the wheel assembly, the front wheel rotation plane and the rear wheel rotation plane have an intersection line, the intersection line seen in a plane extending through the center of the rear wheel parallel to a Z-Y plane of the Cartesian coordinate system being located at a frame side of said X-Y plane, wherein the contact patches of the front wheel and the rear wheel are disposed along a substantially straight trajectory making an acute angle with a rolling direction of the wheel assembly defined by the front wheel and rear wheel, wherein the frame includes a middle wheel mount for holding a middle wheel, wherein the set of wheels includes a middle wheel having a middle wheel rotation axis and a middle wheel rotation plane extending perpendicular to the middle wheel rotation axis and through a center of the middle wheel, and wherein in the assembled state of the wheel assembly:

a) the middle wheel is held by the middle wheel mount, b) a contact patch of the middle wheel is disposed along the trajectory, c) the middle wheel rotation plane and a wheel rotation plane of a wheel in front of the middle wheel have an intersection line, which intersection line seen in a plane extending through the center of the middle wheel parallel to a Z-Y plane of the Cartesian coordinate system is located at a frame side of said X-Y plane, and d) the middle wheel rotation plane and a wheel rotation plane of a wheel behind the middle wheel have an intersection line, which intersection line seen in a plane extending through the center of the middle wheel parallel to a Z-Y plane of the Cartesian coordinate system is located at a frame side of said X-Y plane.

2. A wheel assembly according to claim 1, wherein the front wheel rotation plane or the rear wheel rotation plane extends parallel to the Z-direction.

3. A wheel assembly according to claim 2, wherein the front wheel rotation plane or the rear wheel rotation plane also extends parallel to the X-direction.

4. A wheel assembly according to claim 1, wherein the front wheel rotation plane is oriented such that a rolling direction of the front wheel over a plane ground surface when the X-Y plane of the wheel assembly is parallel to said ground surface is in the X-direction.

5. A wheel assembly according to claim 1, wherein the rear wheel rotation plane is oriented such that a rolling direction of the rear wheel over a plane ground surface when the X-Y plane of the wheel assembly is parallel to said ground surface is in the X-direction.

6. A wheel assembly according to claim 1, wherein seen in a plane parallel to a Z-Y plane of the Cartesian coordinate system, an angle between the middle wheel rotation plane and the front wheel rotation plane is smaller than an angle between the rear wheel rotation plane and the front wheel rotation plane.

7. A wheel assembly according to claim 6, wherein a ratio of the angle between the middle wheel rotation plane and the front wheel rotation plane and the angle between the middle wheel rotation plane and the rear wheel rotation plane is substantially equal to a ratio of a distance between the middle wheel rotation axis and the front wheel rotation axis and a distance between the middle wheel rotation axis and the rear wheel rotation axis.

8. A wheel assembly according to claim 7, wherein an angle between the front wheel rotation plane and the rear wheel rotation plane is in the range of 3-6 degrees.

9. A wheel assembly according to claim 1, wherein seen in a plane parallel to a Z-Y plane of the Cartesian coordinate system, an angle between the front wheel rotation plane and the rear wheel rotation plane is in the range of 0.1-20 degrees.

10. A wheel assembly according to claim 9, wherein the angle between the front wheel rotation plane and the rear wheel rotation plane is in the range of 1-11 degrees.

11. A wheel assembly according to claim 9, wherein the angle between the front wheel rotation plane and the rear wheel rotation plane is in the range of 2-9 degrees.

12. A wheel assembly according to claim 1, wherein a location or orientation of one or more rotation planes of respective one or more wheels of the set of wheels are adjustable.

13. In combination a left wheel assembly for a left skate shoe and a right wheel assembly for a right skate shoe to form a pair of wheel assemblies for a pair of inline skates, wherein the left and right wheel assembly are both a wheel assembly according to claim 1.

14. The combination of claim 13, wherein the left wheel assembly is mirror symmetric with respect to the right wheel assembly.

15. A wheel assembly according to claim 14, wherein the left wheel assembly is mirror symmetric with respect to the right wheel assembly only after ignoring an offset camber angle.

16. The combination of claim 13, wherein the contact patch of the front wheel of the left wheel assembly and the contact patch of the front wheel of the right wheel assembly are arranged more to an outside of the respective left and right wheel assembly than the corresponding contact patch of the rear wheel of the left wheel assembly and the contact patch of the rear wheel of the right wheel assembly.

17. The combination of claim 13, wherein the contact patch of the front wheel of the left wheel assembly and the contact patch of the front wheel of the right wheel assembly are arranged more to an inside of the respective left and right wheel assembly than the corresponding contact patch of the rear wheel of the left wheel assembly and the contact patch of the rear wheel of the right wheel assembly.

18. An inline skate comprising a skate shoe and a wheel assembly according to claim 1.

19. An inline skate according to claim 18, wherein the skate shoe defines a foot supporting surface configured to support a foot of a user, which foot supporting surface is substantially perpendicular to the Z-direction.

20. A wheel assembly according to claim 1, wherein the acute angle is in the range of 0.1-20 degrees.

* * * * *